US006289613B1

(12) United States Patent
Satzler

(10) Patent No.: US 6,289,613 B1
(45) Date of Patent: Sep. 18, 2001

(54) EJECTOR MECHANISM FOR AN EXCAVATING WHEEL USED IN A DREDGING OPERATION AND ASSOCIATED METHOD

(75) Inventor: Ronnie L. Satzler, Princeville, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/529,695

(22) PCT Filed: Mar. 20, 2000

(86) PCT No.: PCT/US00/07354

§ 371 Date: Apr. 18, 2000

§ 102(e) Date: Apr. 18, 2000

(51) Int. Cl.[7] ..... E02F 3/08

(52) U.S. Cl. ..... 37/337; 37/352; 37/901

(58) Field of Search ..... 37/91, 92, 93, 37/189, 309, 337, 338, 347, 350, 351, 360, 901; 172/39, 55, 559

(56) References Cited

U.S. PATENT DOCUMENTS

| | | |
|---|---|---|
| 4,197,036 | 4/1980 | Masquelier . |
| 4,267,652 | 5/1981 | Senesac . |
| 4,397,106 | 8/1983 | MdDowell . |
| 4,887,371 | 12/1989 | Kaiser . |
| 5,020,858 | 6/1991 | Nishikawa . |
| 5,903,989 | 5/1999 | Satzler . |
| 5,907,915 | 6/1999 | Satzler . |
| 5,960,570 | 10/1999 | Satzler . |

*Primary Examiner*—Robert E. Pezzuto
(74) *Attorney, Agent, or Firm*—Blackwell Sanders Peper Martin

(57) ABSTRACT

An ejector mechanism (20) adapted for use on a dredging apparatus (10) to remove silt from under the surface of a body of water and associated method, the dredging apparatus being operative in a forward and reverse direction and including first (32) and second (34) excavating wheel assemblies each having a plurality of silt retaining chambers (40) associated respectively therewith, the ejector mechanism urging the silt material from the respective chambers as the wheel assemblies rotate during a dredging operation and including a crankshaft member (56) rotatably mounted to the wheel frame assembly (24, 62, 64) and having first (58) and second (60) eccentric arm portions associated therewith, the crankshaft member (56) being operatively coupled to the first (32) and second (34) wheel assemblies for rotation in proportion to the rotation of the wheel assemblies, the crankshaft member (56) being rotatable in both a clockwise and counterclockwise direction based upon the direction of movement of the dredging apparatus (10), and first (70) and second (72) ejector members coupled to the first (58) and second (60) eccentric arm portions, the eccentric arm portions being oriented such that the ejector members (70, 72) will move into each of the silt retaining chambers (40) associated with both wheel assemblies (32, 34) during one revolution of the wheel assemblies (32, 34).

15 Claims, 5 Drawing Sheets

EJECTOR MECHANISM FOR AN EXCAVATING WHEEL USED IN A DREDGING OPERATION AND ASSOCIATED METHOD

TECHNICAL FIELD

This invention relates generally to an ejector mechanism for an excavating wheel mechanism and associated method, more particularly, to an ejector mechanism operatively positioned in association with the excavating wheel mechanism of a dredging apparatus for removing silt from the bottom of a body of water, the ejector mechanism being operable regardless of the direction of rotation of the excavating wheel.

BACKGROUND ART

Various types of ejector mechanisms have been used in the past to force material from a chamber. For example, it is known to use a pusher plate in a bucket for an excavator machine or in a bowl for a scrapper machine to force the material out of the bucket or bowl. These known pusher plates are normally controlled by a hydraulic cylinder so that when it is desired by the operator to eject the material, the operator merely operates a control valve which results in the hydraulic cylinder pushing the plate forward to force the material out of the bucket or bowl.

In strip mining applications, large excavating wheels have been used to remove overburden material so that coal can be harvested. These large wheel type excavating machines merely scoop up the overburden material in a plurality of individual scoops and as the individual scoops of the large wheel reach the topmost point of the wheel rotation, the overburden material falls out of the scoops onto a conveyor.

In a dredging application, an excavating wheel mechanism is used for removing silt, sand, mud or other sediment form the bottom of a body of water. One such dredging apparatus is disclosed in U.S. Pat. No. 5,907,915 and includes a floatation arrangement operative to float on the surface of the body of water, a frame structure mounted on the floatation arrangement, a silt excavating wheel mechanism rotatably mounted to the frame structure and operative to extract silt from under the body of water, and an ejector mechanism operative to urge the silt material from the silt retaining chambers associated with the wheel mechanism.

Typically, the dredging apparatus and its associated excavating wheel and ejector mechanisms are designed and constructed such that the dredging operation takes place in one predetermined direction such as in the forward direction of travel of the dredging apparatus. Since dredging only occurs in one direction, the excavating wheel mechanism is normally only operative in one direction of rotation, namely, either a clockwise or a counterclockwise direction of rotation, and the associated ejector mechanism likewise functions in conjunction with one direction of rotation of the excavating wheel.

It is therefore desirable to provide an ejector mechanism which is operable to urge soft material from the chambers of an excavating wheel regardless of the direction of rotation of the excavating wheel and which will enable a dredging apparatus to be operative in both the forward and reverse directions of travel.

Accordingly, the present invention is directed to overcoming one or more of the problems as set forth above.

DISCLOSURE OF THE INVENTION

In one aspect of the present invention, an ejector mechanism adapted for use on a dredging apparatus to remove silt from under the surface of a body of water, the dredging apparatus including an excavating wheel assembly having a plurality of silt retaining chambers defined therein, the excavating wheel assembly being rotatably mounted to a wheel frame assembly. The ejector mechanism includes a crankshaft member rotatably mounted to the wheel frame assembly and having an eccentric arm portion associated therewith, the crankshaft member being operatively coupled to the excavating wheel assembly and being operative to rotate in proportion to the rotation of the excavating wheel assembly, and an ejector member coupled to the eccentric arm portion of the crankshaft member, the eccentric arm portion being oriented such that the ejector member is moved into each of the silt retaining chambers during one revolution of the excavating wheel assembly.

In another aspect of this invention, a method for removing material from a plurality of chambers defined within a pair of first and second wheel assemblies associated with a dredging apparatus, the dredging apparatus being operative in both a forward and reverse direction, the first and second wheel assemblies being rotatably mounted to a wheel frame assembly for movement in both a clockwise and a counterclockwise direction based upon the direction of movement of the dredging apparatus is disclosed. The method includes the following steps of rotatably mounting a crankshaft member to the wheel frame assembly, the crankshaft member having first and second eccentric arm portions associated therewith, operatively coupling the crankshaft member to the first and second excavating wheel assemblies such that the crankshaft member rotates in proportion to the rotation of the first and second wheel assemblies and in both a clockwise and a counterclockwise direction based upon the direction of movement of the dredging apparatus, providing first and second ejector members for coupling respectively to the first and second eccentric arm portions of the crankshaft member, and orienting the eccentric arm portions relative to each other such that the first ejector member is moved into each of the chambers associated with the first excavating wheel assembly during one revolution of the first wheel assembly and the second ejector member is moved into each of the chambers associated with the second excavating wheel assembly during one revolution of the second wheel assembly.

BRIEF DESCRIPTION OF THE DRAWINGS

For a better understanding of the present invention, reference may be made to the accompanying drawings in which.

BEST MODE FOR CARRYING OUT THE INVENTION

Figure 1:
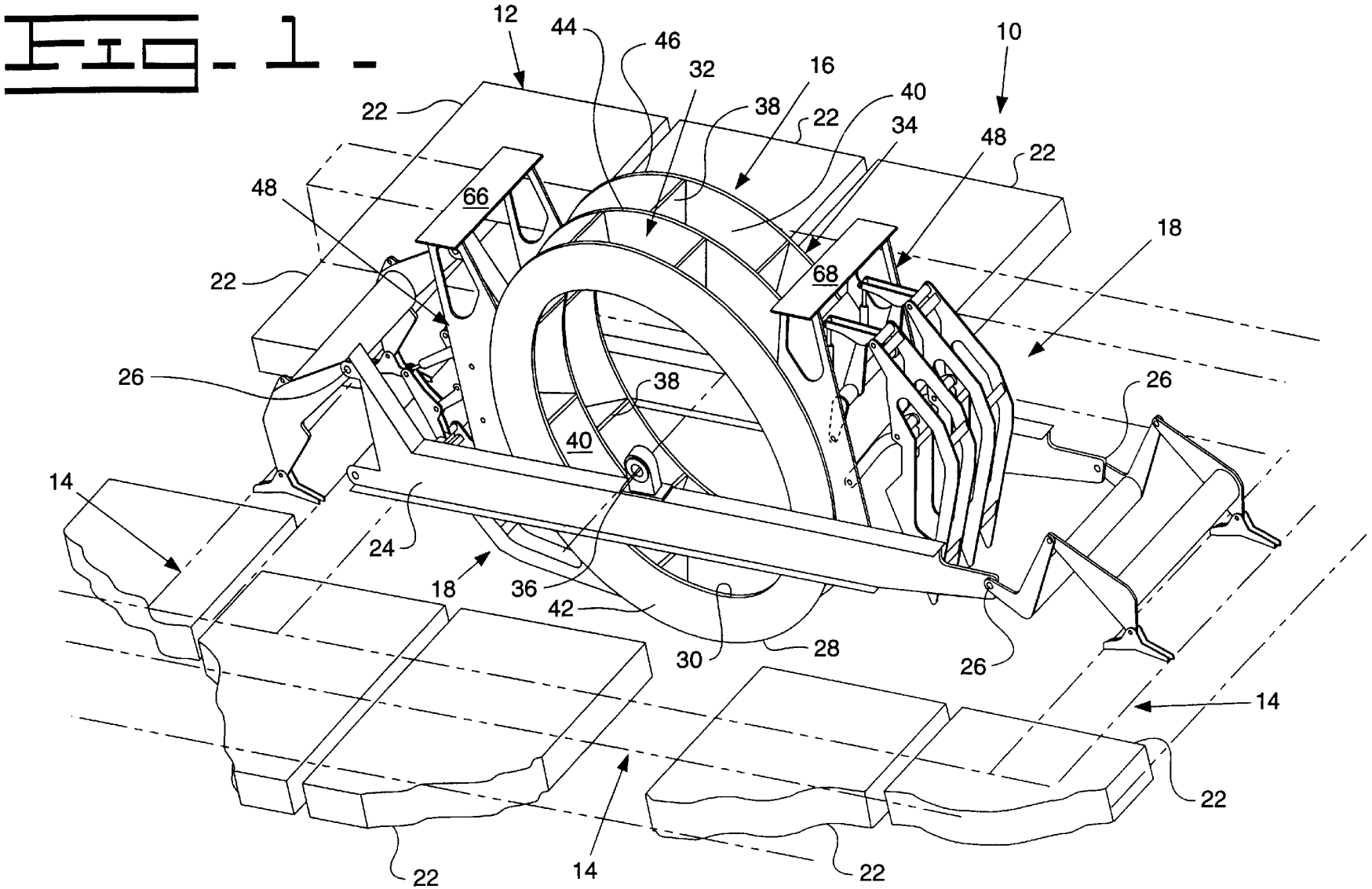
FIG. 1 is a partial prospective view of a typical dredging apparatus adapted to utilize the ejector mechanism of the present invention, the ejector mechanism being removed from the wheel frame assembly for illustrative purposes only.

Referring to the drawings, numeral 10 in FIG. 1 discloses a portion of a dredging apparatus 10 which is adapted to remove silt from the bottom of a body of water in both a forward and a reverse direction of travel, the apparatus 10 including a floatation arrangement 12, a base frame structure 14 connected to the floatation arrangement 12, a silt excavating wheel mechanism 16 operative to remove silt from underneath the body of water, a pair of shield/shoe mechanisms 18 operative to shield the wheel mechanism 16 from the water during the time the silt is being removed from the bottom of the body of water depending upon the particular direction of travel of the apparatus 10, and an ejector mechanism 20 operative to aid in the removal of the silt from the wheel mechanism 16. Although not illustrated in FIG. 1, a typical dredging apparatus such as the apparatus 10 would also include a conveying system operative to transport the silt away from the wheel mechanism 16, a height adjustment mechanism (not shown) operative to raise and lower the wheel mechanism 16 relative to the silt bed, and a propulsion and steering system (not shown) for maneuvering the apparatus 10 on the body of water.

The floatation arrangement 12 includes a plurality of individual floats 22 interconnected to each other by the frame structure 14 to form a base platform. The floatation arrangement 12 also includes a buoyancy control arrangement operative to control the level of the platform by increasing or decreasing the buoyancy of at least certain ones of the plurality of floats 22 in order to compensate for changes in weight distribution.

The silt excavating wheel mechanism 16 includes a wheel frame assembly 24 pivotally connected to the frame structure 14 at a plurality of pivot points 26 and a height adjusting mechanism (not shown). The silt excavating wheel mechanism 16 has an outermost circumference 28, an innermost circumference 30, and includes first and second wheel assemblies 32 and 34 rotatably mounted to the wheel frame assembly 24 about an axis 36. The first and second wheel assemblies 32 and 34 may be secured or otherwise attached one to the other, or such assemblies may be made as one integral unit. It is also recognized that a single wheel assembly such as wheel assembly 32 or 34 could likewise be adapted for use with the dredging apparatus 10 without departing from the spirit and scope of the present invention. In similar fashion, although the axis 36 is illustrated as being parallel with the surface of the water, it is recognized and anticipated that other wheel axis configurations and arrangements may likewise be utilized. For example, it is recognized that the wheel mechanism 16 could be rotatably mounted to the base frame structure 14 and a different type of height adjustment control mechanism could be utilized.

Each of the first and second wheel assemblies 32 and 34 include a plurality of radially spaced vanes 38 that define respective silt retaining chambers 40. The vanes 38 are substantially straight and are positioned between the opposed wheel side members 42, 44 and 46 as best illustrated in FIG. 1, the wheel side member 44 forming a divider wall between the first and second wheel assemblies 32 and 34. Each of the respective vanes 38 extends from the outermost circumference 28 of the respective wheel assemblies 32 and 34 to the innermost circumference 30 thereof. As illustrated, the vanes 38 associated with one wheel assembly 32 are radially offset from the vanes 38 associated with the other wheel assembly 34 as best illustrated in FIG. 1.

The wheel assemblies 32 and 34 are typically driven by a fluid motor assembly (not shown) in a conventional manner. In addition, a typical dredging apparatus will likewise include a propulsion and steering system (not shown). These systems will normally include a pair of independent drive wheel assemblies or spade wheels which are utilized to both steer the dredging apparatus 10 as well as propel the apparatus in both a forward and a reverse direction. Each drive wheel assembly will normally include a fluid driven drive wheel, a linkage arrangement disposed between the fluid driven drive wheel and the frame structure of the dredging apparatus, a fluid actuated cylinder operative to raise and lower the drive wheel assembly, and a plurality of spade shaped members attached to the periphery of the drive wheel operative to penetrate the silt for traction. The propulsion and steering system is operative in a well known manner to propel and steer the dredging apparatus 10 and the associated linkage arrangement is likewise operative in a well known manner to maintain the respective drive wheels in a generally vertical orientation during raising and lowering. Also, the respective drive wheel assemblies are typically independently controlled and steering is achieved by turning one drive wheel faster or slower as compared to the other drive wheel.

A wide variety of different types of conveyor systems can likewise be utilized with the dredging apparatus 10 without departing from the spirit and scope of the present invention. An appropriate conveyor mechanism such as the conveyor system illustrated in U.S. Pat. No. 5,907,915 would be operatively located to receive the removed silt from the respective wheel assemblies 32 and 34 and thereafter transport and deposit such silt at an appropriate storage location such as onto a barge or some other transporting mechanism.

Figure 2:
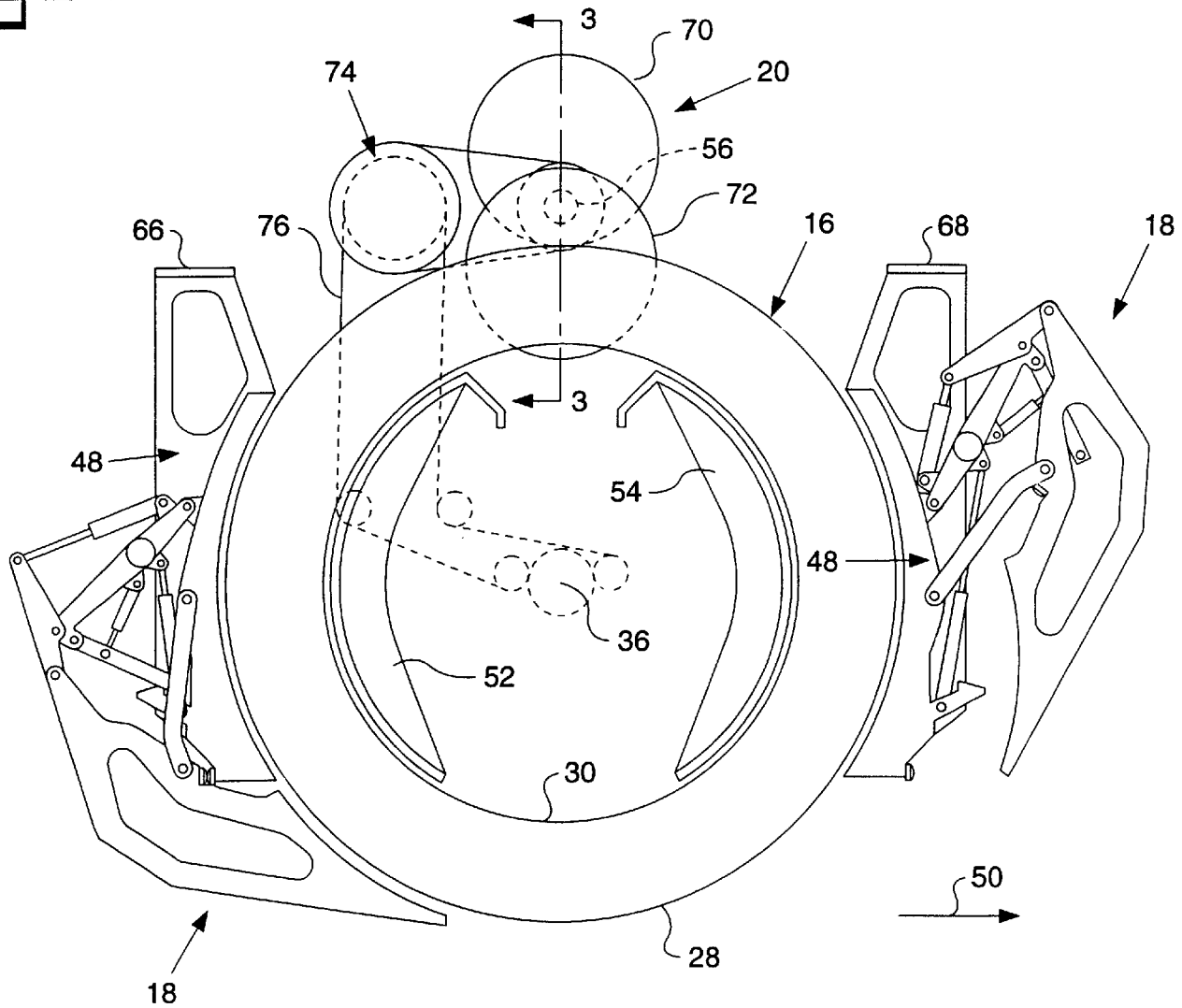
FIG. 2 is a side elevational view illustrating the position and location of the present ejector mechanism relative to an excavating wheel mechanism adaptable for use in a dredging operation in both a clockwise and counterclockwise direction of rotation.

FIG. 2 illustrates the outer shield/shoe mechanisms 18 pivotally connected to the wheel frame portions 48, one outer shield mechanism 18 being located adjacent the portion of the outermost circumference 28 that is on the trailing side of the respective wheel assemblies 32 and 34 and the other shield mechanism 18 being located adjacent the portion of the outermost circumference 28 that is on the leading side of the respective wheel assemblies 32 and 34. Based upon the direction of movement of the dredging apparatus 10 as indicated by arrow 50 in FIG. 2, the trailing shoe mechanism 18 is positioned in its operative position and the leading shoe mechanism 18 is positioned in its retracted position. Each outer shield mechanism 18 is pivotally attached to portion 48 of the wheel frame assembly at a plurality of pivot points and each has a combined width substantially equal to the width of the wheel assemblies 32 and 34.

In the specific configuration illustrated in FIG. 2, the dredging apparatus 10 would be moving in the direction of arrow 50 and the wheel assemblies 32 and 34 would be rotating in a clockwise direction. As the wheel assemblies 32 and 34 rotate, the respective silt retaining chambers 40 move through the body of water at a depth sufficient to effectively fill each such chamber with silt. As the silt retaining chambers 40 continue to move through the body of water, the outer arcuate shield mechanism 18 on the trailing side of the wheel assemblies 32 and 34 shield the silt from the water and hold the silt in the respective chambers.

In this regard, a pair of inner arcuate shield/shoe members 52 and 54 are likewise connected to the wheel frame assembly 24 and are disposed along a portion of the respective wheel assemblies 32 and 34 adjacent the innermost circumference 30. Depending upon the direction of rotation of the wheel assemblies 32 and 34, one of the inner arcuate shoe members 52 or 54 will extend adjacent the innermost circumference 30 of each wheel assembly at a location near the bottom portion of the wheel assemblies 32 and 34 adjacent the silt retaining chambers 40 that are filled with silt to a point just prior to ejection of the silt near the top portion of the wheel assemblies, while the other inner arcuate shoe member 52 or 54 will extend along a portion of the innermost circumference 30 subsequent to the ejection of the silt to a point generally at which the silt retaining chambers 40 reenter the body of water. As a result, one inner arcuate member 52 or 54 helps to retain the silt within the silt retaining chambers 40 until just prior to ejection thereof, whereas the other inner arcuate shoe member 52 or 54 will prevent any silt remaining in the respective chambers 40 after ejection thereof from exiting prior to such chambers reentering the body of water.

Figure 3:
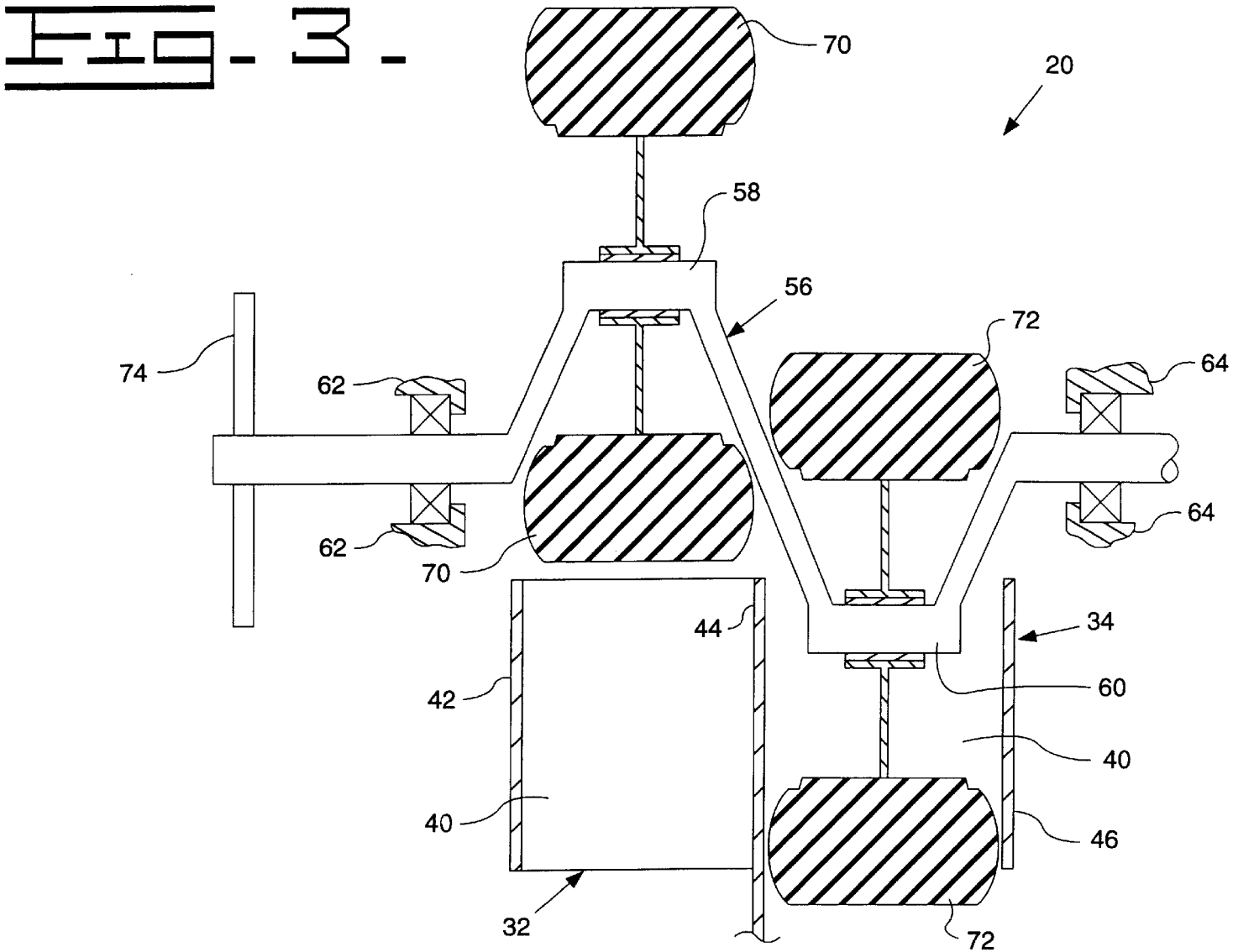
FIG. 3 is a partial cross-sectional view of the present ejector mechanism taken along line 3—3 of FIG. 2.

FIG. 3 illustrates the present ejector mechanism 20 in greater detail. The ejector mechanism 20 includes a crankshaft member 56 which is rotatably connected to a pair of frame members 62 and 64, the members 62 and 64 being attached to the wheel frame assembly 24 at frame portions 66 and 68 adjacent generally the top portion of the wheel assemblies 32 and 34 as illustrated in FIG. 1. The frame members 62 and 64 are generally part of the wheel frame assembly 24. The crankshaft member 56 includes first and second eccentric arm portions 58 and 60 that are orientated 180° from each other as shown in FIG. 3. The orientation of the first and second eccentric arm portions 58 and 60 is based upon the degree of offset between the vanes 38 associated with the respective wheel assemblies 32 and 34. As illustrated in FIG. 3, the eccentric arm portions 58 and 60 are preferably substantially centered over the respective excavating wheel assemblies 32 and 34.

First and second ejector members 70 and 72 are respectively connected or otherwise coupled to the eccentric arm portions 58 and 60 such that rotation of the crankshaft member 56 will cause vertical movement of the ejector members 70 and 72. Although each of the ejector members 70 and 72 is illustrated as being a tire type member, it is recognized and anticipated that differently shaped ejector members could be utilized in conjunction with the present invention so long as the ejector members are capable of urging the silt or other soft material from the chambers 40 as the ejector members 70 and 72 are moved into and out of such chambers. Tire type ejector members are generally preferred because such members can deflect and roll about their own centerline as the ejector members enter and exit each respective chamber 40. In this regard, the ejector members 70 and 72 should be rotatably mounted to the eccentric arm portions 58 and 60 of crankshaft member 56. Each ejector member 70 and 72 should also have a width that is generally greater than at least one half of the width of the respective vanes 38 but less than the overall width thereof. In a preferred embodiment, the width of the respective first and second ejector members 70 and 72 should be greater than 90% but less than 100% of the width of vanes 38.

The crankshaft mechanism 56 is operatively coupled to the excavating wheel assemblies 32 and 34 via a timing device 74 which includes a timing chain or belt 76 as best illustrated in FIG. 2. The timing device 74 functions to rotate the crankshaft 56 in response to the rotation of the wheel assemblies 32 and 34. More particular, the timing device 74 rotates the crankshaft member 74 in proportion to the rotation of the wheel assemblies 32 and 34. As a result, each of the ejector members 70 and 72 is moved into an associated silt retaining chamber 40 as the wheel assemblies 30 and 32 rotate in a particular direction. Since the eccentric arm portions 58 and 60 are 180° out of phase with each other, and since the silt retaining chambers 40 associated with wheel assembly 32 are offset from the chambers 40 associated with wheel assembly 34, one ejector member will be moving into a chamber 40 associated with one of the wheel assemblies 32 or 34 while the other ejector member 72 will be moving out of a chamber 40 associated with the other of the wheel assemblies 32 and 34. This out of phase movement is more particularly illustrated in FIGS. 4–7.

Figure 4:
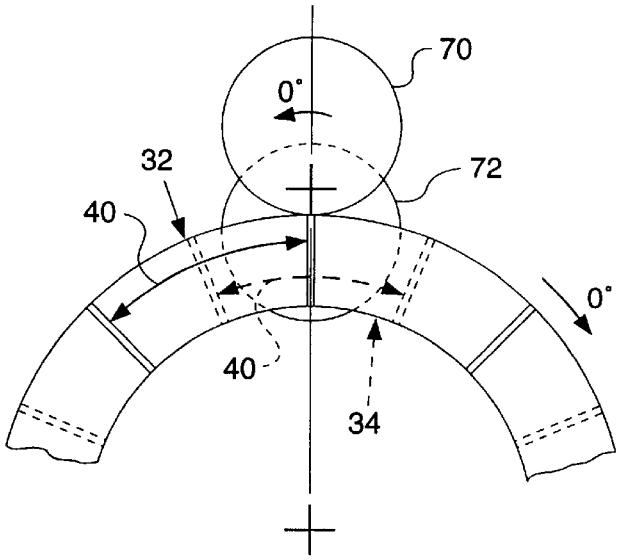
FIG. 4 is a partial side elevational view illustrating the position of the ejector members at 0° of crankshaft rotation.

FIG. 4 illustrates the positioning of the ejector members 70 and 72 at a crankshaft orientation of 0° wherein ejector member 70 is positioned completely out of the topmost silt retaining chambers 40 associated with wheel assembly 32 and ejector member 72 is positioned completely within a corresponding chamber 40 associated with wheel assembly 34. FIG. 4 also illustrates the excavating wheel assemblies 32 and 34 at their respective 0° angle of rotation wherein a chamber 40 associated with wheel assembly 34 is located at the topmost position of wheel assembly 34 and a chamber 40 associated with wheel assembly 32 is offset from the topmost position of wheel assembly 32. During a normal dredging operation wherein the wheel assemblies 32 and 34 are rotating in a clockwise direction, the ejector members 70 and 72 will be rotating in a counterclockwise direction.

Figure 5:
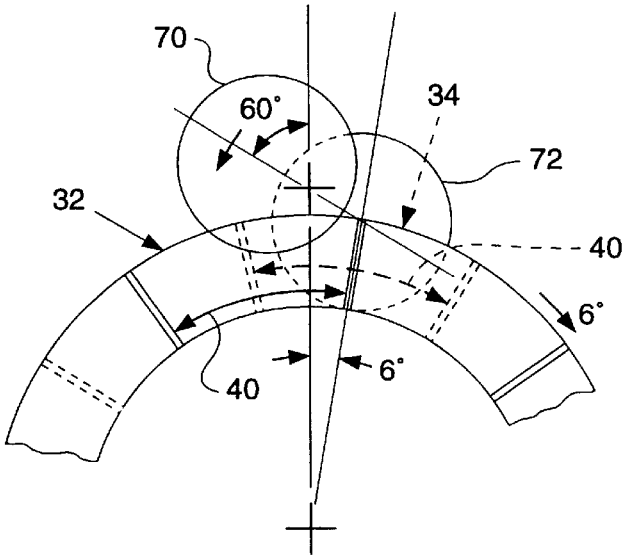
FIG. 5 is a partial side elevational view illustrating the position of the ejector members at 60° of crankshaft rotation.

FIG. 5 illustrates the positioning of the ejector members 70 and 72 at a crankshaft orientation of 60° as compared to the 0° orientation of FIG. 4. At this particular orientation, ejector member 72 is beginning to move out of a chamber 40 associated with wheel assembly 34 and ejector member 70 is beginning to move into a chamber 40 associated with wheel assembly 32. If the respective wheel assemblies 32 and 34 each contain a total of ten silt retaining chambers 40, due to the offset of the respective chambers 40 and the proportional relationship between the movement of the wheel assemblies 32 and 34 relative to the crankshaft member 56 caused by the timing device 74, a counterclockwise rotation of the crankshaft member 56 through 600 of rotation will correspond to a clockwise rotation of the wheel assemblies 32 and 34 through approximately 6° of rotation.

Figure 6:
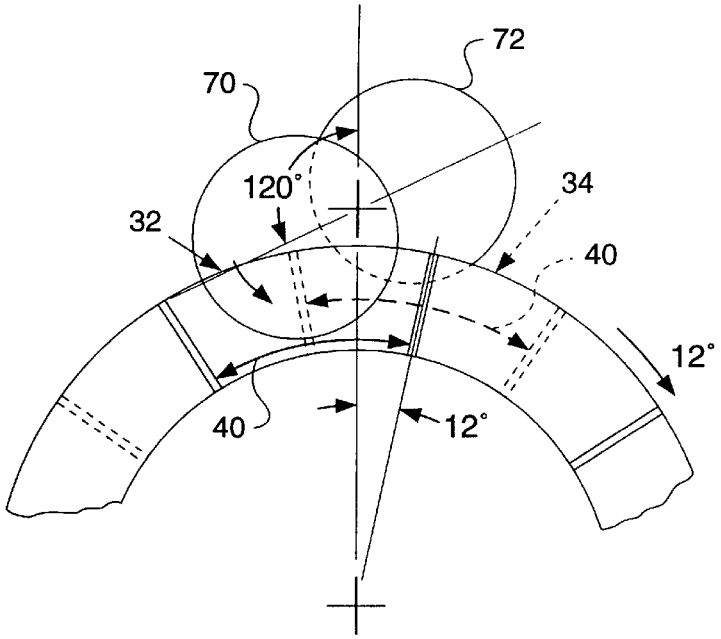
FIG. 6 is a partial side elevational view illustrating the position of the ejector members at 120° of crankshaft rotation.

As compared to the 0° crankshaft orientation of FIG. 4, FIG. 6 illustrates the positioning of the ejector members 70 and 72 at a crankshaft orientation of 120° wherein ejector member 70 is moving further into a chamber 40 associated with wheel assembly 32 and ejector member 72 is moving further out of a chamber 40 associated with wheel assembly 34. Here again, assuming a 10:1 ratio between the rotation of the crankshaft member 56 and the wheel assemblies 32 and 34, a 120° clockwise rotation of crankshaft member 56 will correspond to a 12° clockwise rotation of the respective wheel assemblies 32 and 34.

Figure 7:
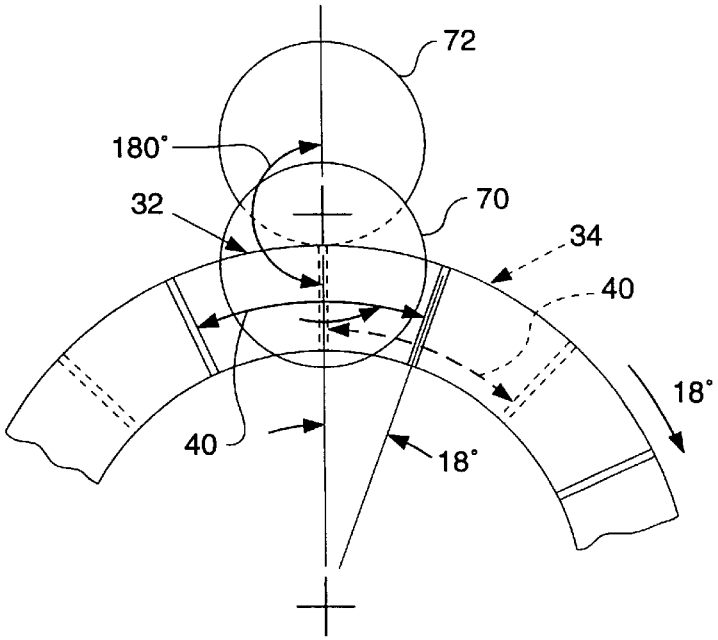
FIG. 7 is a partial side elevational view illustrating the position of the ejector members at 180° of crankshaft rotation.

Similarly, FIG. 7 illustrates the positioning of the ejector members 70 and 72 at a crankshaft orientation of 180° as compared to the 0° orientation illustrated in FIG. 4. At this particular orientation, ejector member 70 has moved completely into a chamber 40 associated with wheel assembly 32 and ejector member 72 has moved completely out of a chamber 40 associated with wheel assembly 34. The 180° counterclockwise rotation of the crankshaft member 56 again corresponds to only an 18° clockwise rotation of wheel assemblies 32 and 34. Consequently, as the wheel assemblies 32 and 34 continue to rotate in a clockwise direction, each of the ejector members 70 and 72 will move into and out of corresponding silt retaining chambers 40. As the wheel assemblies 32 and 34 complete one revolution or 360° of rotation, the respective ejector members 70 and 72 will have moved into and out of each chamber 40 associated with each wheel assembly 32 and 34.

Since the dredging apparatus 10 illustrated in FIGS. 1 and 2 is capable of performing a dredging operation in both the forward and reverse directions of travel, rotational movement of the wheel assemblies 32 and 34 in a counterclockwise direction will cause the timing device 74 to operate in a reverse direction thereby causing crankshaft member 56 and ejector members 70 and 72 to rotate in a clockwise direction. In all other respects, the movement and operation of the ejector mechanism 20 will remain substantially the same as the movement and operation previously explained with respect to FIGS. 4–7 except that the ejector members will be rotating in a clockwise direction whereas the wheel assemblies 32 and 34 will be rotating in a clockwise direction.

Although the excavating wheel mechanism 16 has been described and illustrated as comprising a pair of wheel assemblies 32 and 34, it is recognized and anticipated that wheel assembly 16 may be comprised of a signal wheel assembly 32 or 34 and that the present ejector mechanism 20 can be adapted for operation with a single excavating wheel assembly without departing from the spirit and scope of the present invention. In this situation, crankshaft member 56 would include a single eccentric arm portion such as arm portion 58 or 60 and a single ejector member such as ejector member 70 or 72. In all other aspects, the operation of the present ejector mechanism 20 would remain substantially the same as previously described.

Industrial Applicability

The present ejector mechanism 20 is adaptable for use with a wide variety of different types of dredging apparatus wherein one or more silt excavating wheel assemblies are utilized to remove silt or other sediment from under a body of water. When the present ejector mechanism 20 is rotatably attached to the excavating wheel frame assembly 24 adjacent the top portion of the wheel mechanism 16 as best illustrated in FIG. 2, the dredging apparatus 10 will be capable of performing a dredging operation in both the forward and reverse directions of travel and the present ejector mechanism 20 will be able to eject the silt or sediment material contained in the respective silt retaining chambers 40 when such chambers reach their topmost position regardless of the direction of rotation of the wheel mechanism 16.

Use of the present ejector mechanism 20 during a dredging operation is as follows. With the dredging apparatus 10 moving in the direction of arrow 50 (FIG. 2), the wheel assemblies 32 and 34 will be rotating in a clockwise direction. As the excavating wheel assemblies rotate, the respective silt retaining chambers move through the body of water towards the topmost position of the respective wheel assemblies. As the chambers 40 move upward towards the top of the wheel assemblies, the respective outer and inner shield/shoe mechanisms 18 and 52 on the trailing side of the wheel mechanism 16 will function to both hold the silt within the respective chambers 40 and shield such silt from the water.

Once the silt retaining chambers 40 reach the topmost position of the respective wheel assemblies 32 and 34, the silt is in position to be removed from the chambers 40 and deposited onto a conveyor system or other means for transporting the silt to an appropriate storage area. As the chambers 40 reach the topmost position, the appropriate ejector member 70 or 72 is forced downward into the topmost chamber 40 to eject the silt from such chamber. Since the timing device 74 turns the crankshaft member 56 in relation to the turning of the wheel assemblies 32 and 34, the eccentric arm portions 58 and 60 will move the appropriate ejector member 70 and 72 downward into the topmost chamber 40. As the wheel assemblies continue to rotate, the inner shield/shoe member 54 on the leading side of the wheel mechanism 16 functions to shield or close the respective chambers 40 as they again move downward towards the body of water. In the event that all of the silt did not fall from the respective topmost chambers 40, the inner shield/shoe member 54 will prohibit any remaining silt from falling out of the chambers 40 and into the water.

Since the crankshaft member 56 is operatively coupled to the excavating wheel mechanism 16 through the use of timing device 74, timing device 74 will be operative to rotate crankshaft member 56 in proportion to the rotation of the excavating wheel mechanism 16 based upon the total number of silt retaining chambers 40 associated with the respective wheel assemblies 32 and 34. Construction and adjustment of the timing device 74 can be accomplished in a conventional manner. Therefore, if each wheel assembly 32 and 34 contains ten silt retaining chambers 40, the rotation of crankshaft member 56 will be timed to the rotation of wheel assembly 32 and 34 and such timing would be at a 10:1 ratio. Similarly, if each wheel assembly 32 and 34 contained fifteen silt retaining chambers 40, the timed relationship between crankshaft member 56 and wheel mechanism 16 would be at a 15:1 ratio.

In the event that the dredging apparatus 10 illustrated in FIG. 2 reverses its direction of travel as compared to the direction of movement indicated by arrow 50, the positioning of the respective outer shield/shoe mechanisms 18 can likewise be reversed and a dredging operation can again be performed in the opposite direction. In this particular situation, both the drive wheel assemblies (not shown) as well as the silt excavating wheel assemblies 32 and 34 will be rotated in a counterclockwise direction and the crankshaft member 56 will rotate in a clockwise direction. In all other respects, the operation of the dredging apparatus 10 as well as the operation and function of the respective ejector members 70 and 72 will be substantially the same as previously described.

In view of the foregoing, it is readily apparent that the present ejector mechanism 20 is an effective mechanism to not only aid in the removal of silt from the silt retaining chambers 40 as the dredging apparatus 10 removes silt from under a body of water, but such ejector mechanism likewise enables the dredging apparatus 10 to operate in both a forward and a reverse direction of travel.

The construction and operation of the present ejector mechanism 20 is likewise advantageous for use in a conventional dredging operation where dredging occurs in one direction only such as disclosed in U.S. Pat. No. 5,907,915. In this particular situation, the timing device 74 will be operative in one direction only.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the sprit and scope of the present invention.

Other aspects, objects and advantages of the present invention can be obtained from a study of the drawings, the disclosure and the appended claims.

What is claimed is:

1. An ejector mechanism (20) adapted for use on a dredging apparatus (10) to remove silt from under the surface of a body of water, the dredging apparatus including an excavating wheel assembly (16) having a plurality of silt retaining chambers (40) defined therein, the excavating wheel assembly being rotatably mounted to a wheel frame assembly (24), the ejector mechanism comprising:

a crankshaft member (56) rotatably mounted to the wheel frame assembly (24, 62, 64) and having an eccentric arm portion (58) associated therewith, said crankshaft member being operatively coupled to the excavating wheel assembly (16) and being operative to rotate in proportion to the rotation of the excavating wheel assembly; and an ejector member (70) coupled to the eccentric arm portion (58) of said crankshaft member, said eccentric arm portion being oriented such that the ejector member (70) is moved into each of the silt retaining chambers (40) during one revolution of the excavating wheel assembly (16).

2. The ejector mechanism as set forth in claim 1, wherein said ejector member (70) is a tire member rotatably mounted to the eccentric arm portion (58) of said crankshaft member.

3. The ejector mechanism as set forth in claim 1, wherein the excavating wheel assembly (16) includes first (32) and second (34) excavating wheel assemblies each having a plurality of silt retaining chambers (40) associated respectively therewith, said crankshaft member (56) including a second eccentric arm portion (60) associated therewith, and a second ejector member (72) coupled to said second eccentric arm portion (60) , said first (58) and second (60) eccentric arm portions being oriented such that the first ejector member (70) is moved into each of the silt retaining chambers (40) associated with said first excavating wheel assembly (32) during one revolution of said first wheel assembly (32) and the second ejector member (72) is moved into each of the silt retaining chambers (40) associated with said second excavating wheel assembly (34) during one revolution of said second wheel assembly (34).

4. The ejector mechanism as set forth in claim 3, wherein said first (58) and second (60) eccentric arm portions associated with said crankshaft member (56) are oriented 180° from each other.

5. The ejector mechanism as set forth in claim 4, including a timing device (74) coupled between said crankshaft member (56) and said first (32) and second (34) excavating wheel assemblies, said timing device being operative to rotate said crankshaft member (56) in proportion to the rotation of said first (32) and second (34) wheel assemblies.

6. The ejector mechanism as set forth in claim 1, wherein said ejector member (70) has a width which is less than the width of each respective silt retaining chamber (40).

7. The ejector mechanism as set forth in claim 1, wherein the dredging apparatus (10) is operative in both a forward and a reverse direction of travel, said crankshaft member (56) being operatively coupled to the excavating wheel assembly (16) such that said crankshaft member is rotatable in both a clockwise and a counterclockwise direction based upon the direction of travel of the dredging apparatus.

8. An ejector mechanism adapted for use on a dredging apparatus (10) to remove silt from under the surface of a body of water, the dredging apparatus being operative in a forward and reverse direction and including first (32) and second (34) excavating wheel assemblies each having a plurality of silt retaining chambers (40) associated respectively therewith, the first and second excavating wheel assemblies being rotatably mounted to a wheel frame assembly (24) for movement in both a clockwise and a counterclockwise direction based upon the direction of movement of the dredging apparatus, the ejector mechanism comprising:

a crankshaft member (56) rotatably mounted to the wheel frame assembly (24, 62, 64) and having first (58) and second (60) eccentric arm portions associated therewith, said crankshaft member (56) being operatively coupled to the first and second excavating wheel assemblies and being operative to rotate in proportion to the rotation of the excavating wheel assemblies (32, 34), said crankshaft member (56) being rotatable in both a clockwise and a counterclockwise direction based upon the direction of movement of the dredging apparatus (10); and first (70) and second (72) ejector members coupled to said first (58) and second (60) eccentric arm portions, said first and second eccentric arm portions being oriented such that the first ejector member (70) is moved into each of the silt retaining chambers (40) associated with the first excavating wheel assembly (32) during one revolution of the first wheel assembly (32) and the second ejector member (72) is moved into each of the silt retaining chambers (40) associated with the second excavating wheel assembly (34) during one revolution of the second wheel assembly (34).

9. The ejector mechanism as set forth in claim 8, wherein said first (70) and second (72) ejector members are tire members rotatably mounted respectively to the first (58) and second (60) eccentric arm portions of said crankshaft member (56).

10. The ejector mechanism as set forth in claim 8, wherein said first (58) and second (60) eccentric arm portions are oriented 180° from each other.

11. The ejector mechanism as set forth in claim 8, including a timing device (74) coupled between said crankshaft member (56) and the first (32) and second (34) excavating wheel assemblies, said timing device (74) being operative to rotate said crankshaft member (56) in proportion to the rotation of the first (32) and second (34) wheel assemblies.

12. The ejector mechanism as set forth in claim 8, wherein said ejector members (70,72) have a width which is less than the width of each respective silt retaining chamber (40).

13. A method for removing material from a plurality of chambers (40) defined within a pair of first (32) and second (34) wheel assemblies associated with a dredging apparatus (10), the dredging apparatus being operative in both a forward and reverse direction, the first and second wheel assemblies being rotatably mounted to a wheel frame assembly (24) for movement in both a clockwise and a counterclockwise direction based upon the direction of movement of the dredging apparatus, the method comprising the following steps:

rotatably mounting a crankshaft member (56) to the wheel frame assembly (24, 62, 64), said crankshaft member having first (58) and second (60) eccentric arm portions associated therewith;

operatively coupling said crankshaft member (56) to the first (32) and second (34) excavating wheel assemblies such that said crankshaft member (56) rotates in proportion to the rotation of the first (32) and second (34) wheel assemblies and in both a clockwise and a counterclockwise direction based upon the direction of movement of the dredging apparatus;

providing first (70) and second (72) ejector members for coupling respectively to the first (58) and second (60) eccentric arm portions of said crankshaft member; and orienting said eccentric arm portions (58, 60) relative to each other such that the first ejector member (70) is moved into each of the chambers (40) associated with the first excavating wheel assembly (32) during one revolution of said first wheel assembly (32) and the second ejector member (72) is moved into each of the chambers (40) associated with the second excavating wheel assembly (34) during one revolution of said second wheel assembly (34).

14. The method as set forth in claim 13, wherein said first (70) and second (72) ejector members are tire members rotatably mounted respectively to the first (58) and second (60) eccentric arm portions of said crankshaft member (56).

15. The method as set forth in claim 13, including the following step:

coupling a timing device (74) between said crankshaft member (56) and the first (32) and second (34) wheel assemblies, said timing device (74) being operative to rotate said crankshaft member (56) in proportion to the rotation of the first (32) and second (34) wheel assemblies.

* * * * *